US006406128B2

(12) United States Patent
Lee et al.

(10) Patent No.: US 6,406,128 B2
(45) Date of Patent: Jun. 18, 2002

(54) INK SUPPLY APPARATUS OF PRINTER

(75) Inventors: Beom-ro Lee, Suwon; Kyu-sung Kim, Yongin; Chung-guk Baek, Suwon, all of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/726,124

(22) Filed: Nov. 30, 2000

(30) Foreign Application Priority Data

Jul. 20, 2000 (KR) ..... 00-41733

(51) Int. Cl.[7] ..... B41J 2/01
(52) U.S. Cl. ..... 347/50; 347/19
(58) Field of Search ..... 347/5, 7, 50, 85, 347/86, 87, 19

(56) References Cited

U.S. PATENT DOCUMENTS 5,049,898 A * 9/1991 Arthur et al. ..... 347/19
5,138,344 A * 8/1992 Ujita ..... 347/86
5,272,503 A * 12/1993 Lesueur et al. ..... 355/208
6,227,638 B1 * 5/2001 Childers et al. ..... 347/7

* cited by examiner

*Primary Examiner*—N. Le
*Assistant Examiner*—Anh T. N. Vo
(74) *Attorney, Agent, or Firm*—Sughrue Mion, PLLC

(57) ABSTRACT

An ink supply apparatus of a printer includes an ink supply container for containing ink which includes a memory module for recording information about the ink contained in the ink supply container, a plurality of exposed terminals formed at the outer circumferential surface of the ink supply container, and a plurality of internal signal lines for internally connecting the exposed terminals and the memory module. Further, an ink injection portion, at which the ink supply container is installed, is provided at the printer and includes a connection terminal portion electrically connected to the exposed terminals when the ink supply container is installed. When the ink supply container is installed at the ink injection portion, information can be exchanged between the controller and the memory module.

4 Claims, 4 Drawing Sheets

INK SUPPLY APPARATUS OF PRINTER

BACKGROUND OF THE INVENTION

1. Field of the Invention

The present invention relates to an apparatus for supplying ink in a printer and, more particularly, to an ink supply apparatus of a printer having an improved structure which enables the printer to read property information regarding the ink supplied and which enables an ink supply container to be installed easily.

2. Description of the Related Art

A liquid printer uses ink as a developer and includes an ink supply apparatus for supplying ink.

Referring to explanatory FIG. 1, a typical liquid printer includes a plurality of laser scanning units (LSU) 12 for scanning light to a circulating photoreceptor web 11, and a plurality of developing apparatuses 13 for supplying ink of various colors to the photoreceptor web 11.

Each of the developing apparatuses 13 supplies ink of a predetermined color to the photoreceptor web 11 to develop an electrostatic latent image formed on the photoreceptor web 11 by the corresponding LSU 12. The developing apparatus 13 receives ink through an ink supply apparatus. In this case, the ink supply apparatus includes an ink injection portion 14 installed at the printer and an ink supply container 15 installed at the ink injection portion 14 for supplying ink. The ink supply container 15 is a consumable container for supplying ink, which is installed at the ink injection portion 14, if necessary, and is detached from the printer at all other times.

The properties of the ink used in a printer may vary depending on the manufacturer or technical development. Thus, to obtain high quality print outputs, conditions for development of a printer should be adjusted corresponding to the properties of the supplied ink. Also, to enable normal performance of exchange of information between the printer and the ink supply container 15, electrical connection between an ink injection portion 14 and the ink supply container 15 should be convenient.

SUMMARY OF THE INVENTION

To solve the above problems, it is an object of the present invention to provide an ink supply apparatus of a printer having an improved structure so that information regarding the properties of the ink contained in the ink supply container can be provided to the controller of the printer and also the electrical connection structure is convenient when the ink supply container is installed at the ink injection portion.

Accordingly, to achieve the above object, there is provided an ink supply apparatus of a printer and which comprises an ink supply container for containing ink which includes a memory module for recording information about the ink contained in the ink supply container, a plurality of exposed terminals formed at the outer circumferential surface of the ink supply container, and a plurality of internal signal lines for internally connecting the exposed terminals and the memory module; and an ink injection portion, provided at the printer, at which the ink supply container is installed and which includes a connection terminal portion electrically connected to the exposed terminals when the ink supply container is installed, in which, when the ink supply container is installed at the ink injection portion, information can be exchanged between the controller and the memory module.

BRIEF DESCRIPTION OF THE DRAWINGS

The above object and advantages of the present invention will become more apparent by describing in detail a preferred embodiment thereof with reference to the attached drawings, in which.

DETAILED DESCRIPTION OF THE INVENTION

Figure 1:
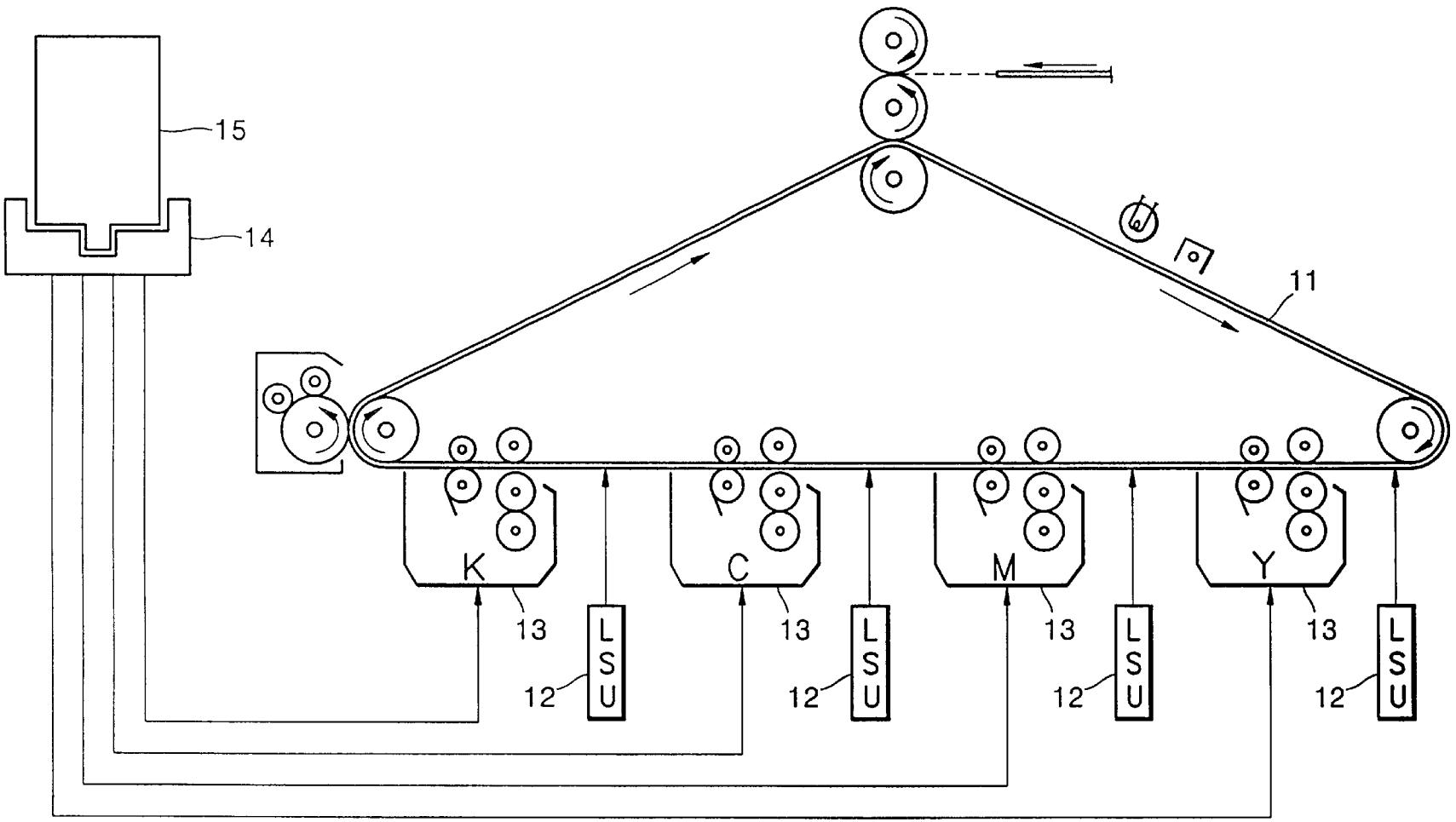
FIG. 1 PRIOR ART
FIG. 1 is an explanatory view showing a liquid printer.
Figure 2:
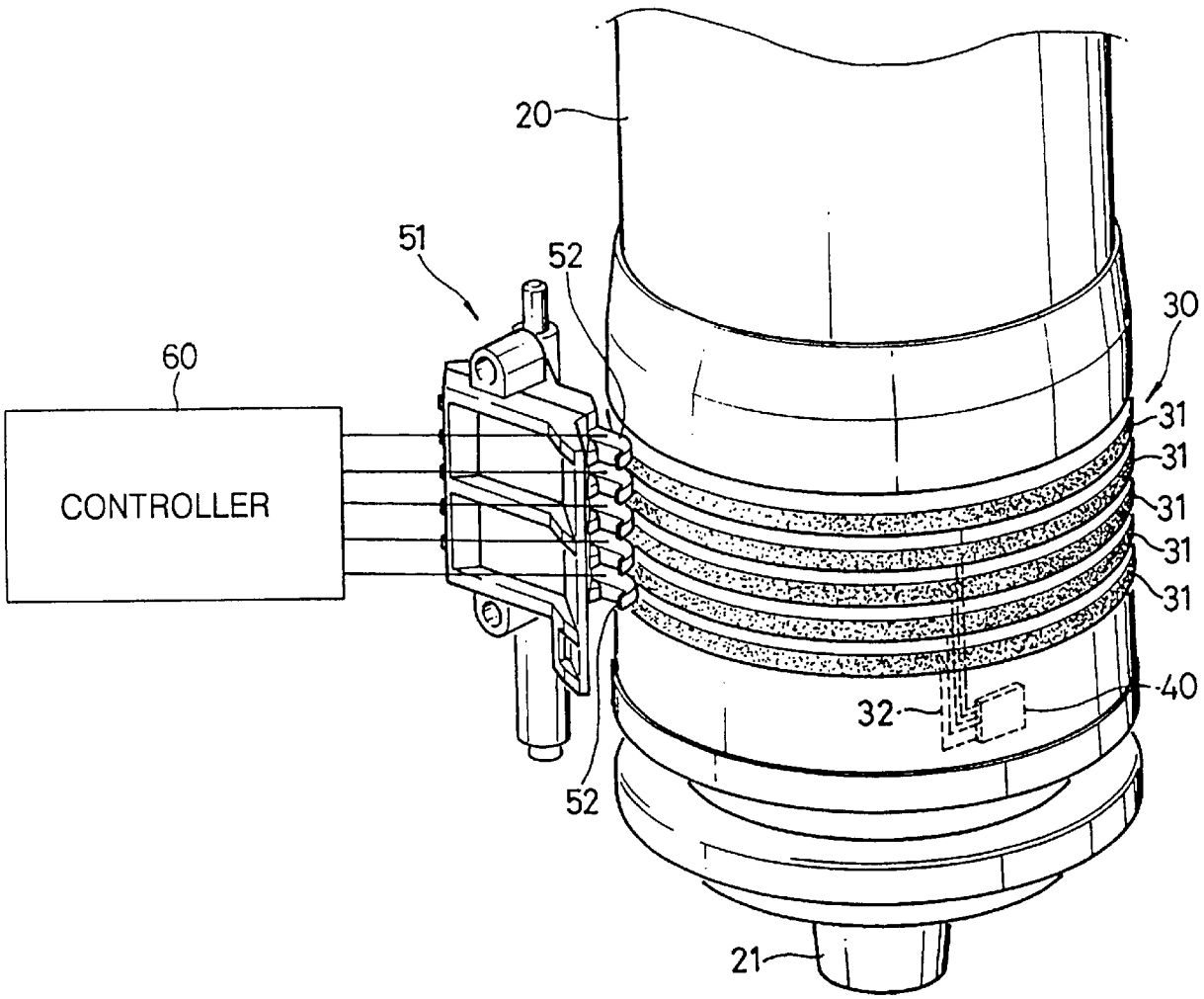
FIG. 2 is a perspective view showing a major portion of the ink supply apparatus of a printer according to a preferred embodiment of the present invention.
Figure 3:
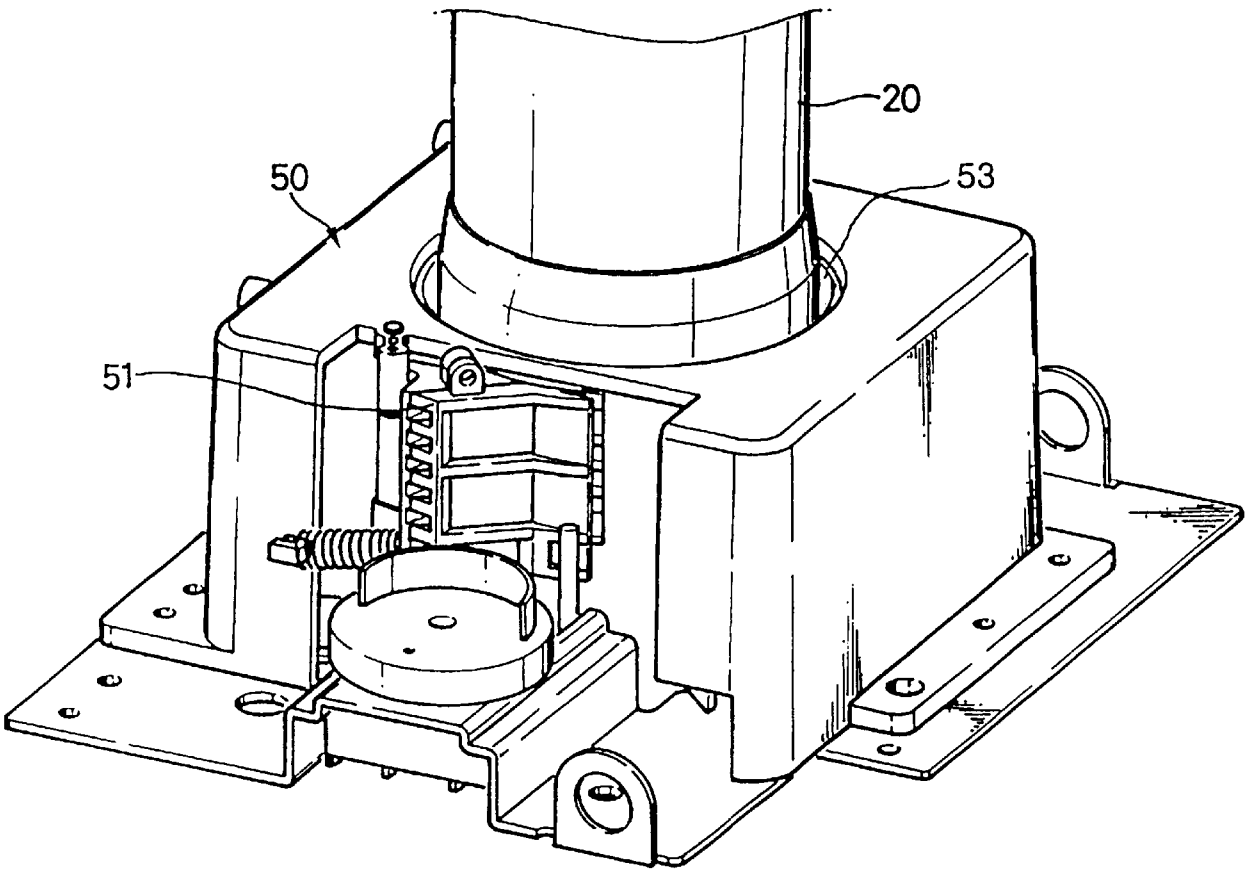
FIG. 3 is a perspective view showing a state in which the ink supply container of FIG. 2 is installed at the ink injection portion of the printer.

Referring to FIGS. 2 and 3, an ink supply apparatus of a printer according to a preferred embodiment of the present invention includes an ink supply container 20 and an ink injection portion 50 provided at the printer. The ink supply container 20 is installed at the ink injection portion 50 when ink is supplied to the printer and includes a container terminal portion 30 and a memory module 40.

The container terminal portion 30 includes a plurality of exposed terminals 31 which are circular strips, separated from and parallel to one another, and internal signal lines 32 which internally connect the exposed terminals 31 and the memory module 40. The exposed terminals 31 are electrically connected to terminals 52 of a connection terminal portion 51 installed at the ink injection portion 50 and the terminals 52 are connected to a controller 60 of the printer. Each of the internal signal lines 32 is electrically separated from the exposed terminals 31 except for the corresponding exposed terminal 31 and also electrically connected to the memory module 40.

Figure 4:
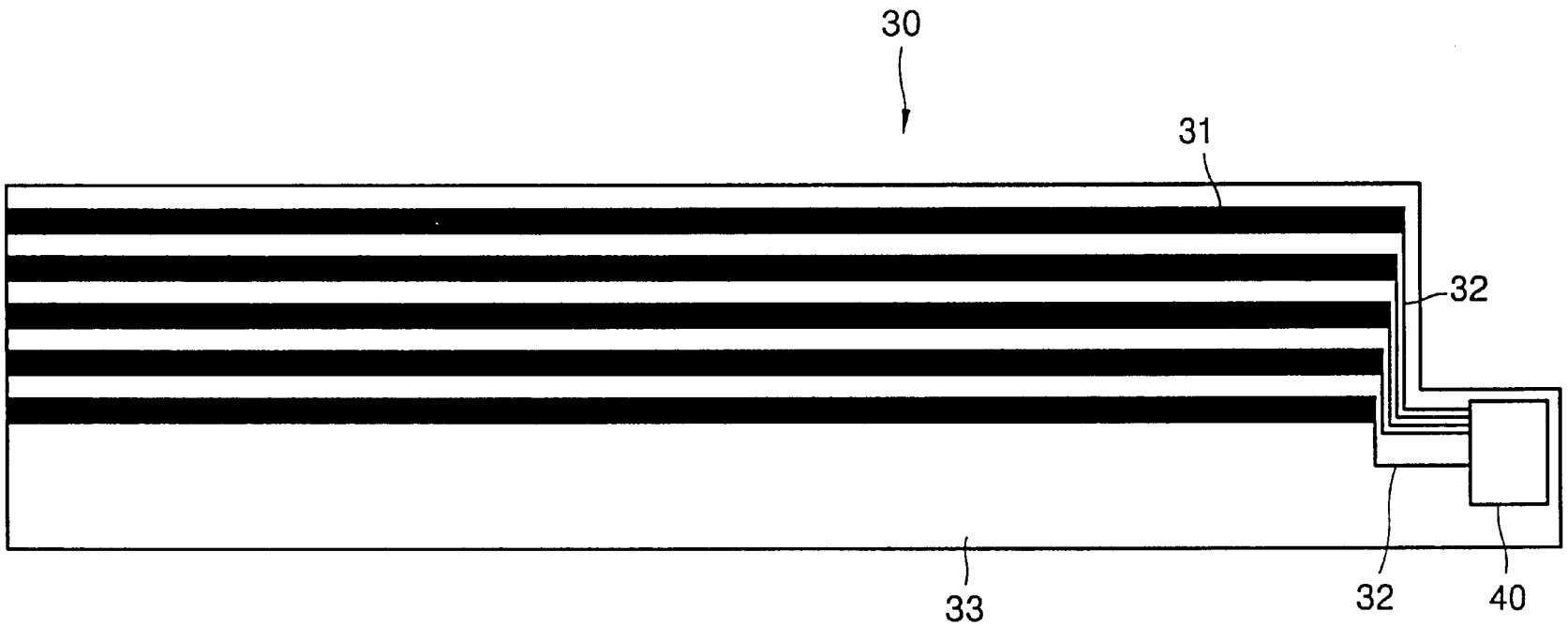
FIG. 4 is a plan view showing a state in which a memory module and a container terminal portion formed on a flexible print substrate are unfolded.

Referring to FIG. 4, the container terminal portion 30 is preferably manufactured by providing the exposed terminals 31, the internal signal lines 32 coated for insulation, and the memory module 40 on a flat flexible printed circuit board 33 and winding the flexible printed circuit board 33 around the outer circumferential surface of the ink supply container 20 in circular strips and attaching the flexible printed circuit board 33 thereon using an adhesive.

The exposed terminals 31 transmit information signals between the memory module 40 and the controller 60 of the printer and also provide electric power to the memory module 40. For example, the exposed terminals 31 include an electric power supply terminal for supplying electric power, a serial data terminal for transmitting serial data to the memory module 40, and a clock terminal for transmitting a clock signal to the memory module 40.

The memory module 40 contains information about ink stored in the ink supply container 20. In this case, the ink related information includes the ink manufacturer, expiration date of the ink, color information of the ink, and conductivity of the ink. Also, a property code indicating that the supplied ink is a genuine product is preferably recorded on the memory module 40 so that the property code can act as one factor in determining whether the ink is supplied. Further, it is preferable to record a code to indicate that the ink has been completely used up in order to prevent unauthorized refilling of ink after use of the ink supply container 20, that is, after the ink stored in the ink supply container 20 is completely supplied through the ink injection portion 50.

The ink injection portion 50 includes an ink injection hole 53 formed such that an ink outlet portion 21 (see FIG. 2) of the ink supply container 20 can be inserted to a predetermined depth and the connection terminal portion 51 having the terminals 52 corresponding to each of the exposed terminals 31 of the installed ink supply container 20. The terminals 52 are electrically connected to the controller 60 and transmit signals between the memory module 40 and the controller 60.

Preferably, the ink supply container 20 has a cylindrical shape and the ink injection portion 50 has a depressed shape corresponding to the shape of the ink supply container 20. In this case, when the ink supply container 20 is installed at the ink injection portion 50, the exposed terminals 31 and the terminals 52 are connected to one another without considering relative direction in rotating the ink supply container 20 with respect to the ink injection portion 50. That is, even when the ink supply container 20 is rotated in the ink injection hole 53, the exposed terminals 31 maintain electrical connection with the corresponding terminals 52.

Thus, a user needs only to install the ink supply container 20 at the ink injection portion 50 such that the ink outlet portion 21 of the ink supply container 20 is directed toward the ink injection hole so that the memory module 40 and the controller 60 are connected to each other.

According to the structure of the ink supply container 20, by inserting the ink supply container 20 in the ink injection portion 50 of the printer without considering rotational direction, the controller 60 can read information recorded on the memory module 40 through the terminals 52 and the exposed terminals 31 so that printing conditions appropriate for the supplied ink can be adjusted.

As described above, the ink supply container according to the present invention provides information about the property of the ink stored in the ink supply container to the controller of the printer, so that when it is installed at the printer, the printing conditions can be optimized. Also, by making the ink supply container cylindrical and providing the terminals in circular strips wound around the ink supply container, the memory module and the controller are connected without considering the relative direction when the ink supply container is installed at the ink injection portion.

It is contemplated that numerous modifications may be made to the ink supply apparatus of the present invention without departing from the spirit and scope of the invention as defined in the following claims.

What is claimed is:

1. An ink supply apparatus of a printer which includes a controller, comprising:

an ink supply container which contains ink and which includes a memory module for recording information about the ink contained in the ink supply container, a plurality of exposed terminals formed at an outer circumferential surface of the ink supply container, and a plurality of internal signal lines for internally connecting the exposed terminals and the memory module; and an ink injection portion, provided at the printer, at which the ink supply container is installed and which includes a connection terminal portion electrically connected to the exposed terminals when the ink supply container is installed, wherein, when the ink supply container is installed at the ink injection portion, information is operative to be exchanged between the controller and the memory module.

2. The apparatus as claimed in claim 1, wherein the exposed terminals, the internal signal lines, and the memory module are provided on a flat flexible printed circuit board and the flat flexible printed circuit board is attached on the outer circumferential surface of the ink supply container.

3. The apparatus as claimed in claim 1, wherein the ink supply container is cylindrical and the exposed terminals are exposed in circular strips along the outer circumferential surface of the ink supply container, the ink injection portion is formed to be depressed corresponding to a shape of the ink supply container, so that the exposed terminals and the connection terminal portion are electrically connected without considering a direction that the ink supply container is inserted into the ink injection portion.

4. The apparatus as claimed in claim 1, wherein the exposed terminals comprise an electric power supply terminal for supplying electric power to the memory module, a serial data terminal for transmitting serial data to the memory module, and a clock terminal for transmitting a clock signal to the memory module.

* * * * *